US010337525B2

(12) United States Patent
Havel

(10) Patent No.: US 10,337,525 B2
(45) Date of Patent: Jul. 2, 2019

(54) VEHICLE COOLING FAN WITH AERODYNAMIC STATOR STRUTS

(71) Applicant: Magna Powertrain Bad Homburg GmbH, Bad Homburg (DE)

(72) Inventor: Brian Havel, Aschaffenburg (DE)

(73) Assignee: MAGNA ELECTRONICS INC., Auburn Hills, MI (US)

( * ) Notice: Subject to any disclaimer, the term of this patent is extended or adjusted under 35 U.S.C. 154(b) by 344 days.

(21) Appl. No.: 15/120,868

(22) PCT Filed: Mar. 12, 2015

(86) PCT No.: PCT/US2015/020074

§ 371 (c)(1),
(2) Date: Aug. 23, 2016

(87) PCT Pub. No.: WO2015/138672

PCT Pub. Date: Sep. 17, 2015

(65) Prior Publication Data

US 2016/0363132 A1 Dec. 15, 2016

Related U.S. Application Data

(60) Provisional application No. 61/952,334, filed on Mar. 13, 2014.

(51) Int. Cl.

| | |
|---|---|
| ***F04D 25/08*** | (2006.01) |
| ***F04D 25/06*** | (2006.01) |
| ***F04D 29/54*** | (2006.01) |

(52) U.S. Cl.

CPC ..... *F04D 29/544* (2013.01); *F04D 25/06* (2013.01); *F04D 25/08* (2013.01);
(Continued)

(58) Field of Classification Search

CPC ..... F04D 25/06; F04D 25/08; F04D 29/544; F05D 2240/121; F05D 2240/122;
(Continued)

(56) References Cited

U.S. PATENT DOCUMENTS 1,862,827 A * 6/1932 Carnegie ..... F01D 5/141 415/168.1
4,548,548 A 10/1985 Gray, III
(Continued)

FOREIGN PATENT DOCUMENTS

CN 1975177 A 6/2007
CN 102367810 A 3/2012

OTHER PUBLICATIONS

International Search Report and Written Opinion dated Jun. 24, 2015 from corresponding PCT Application No. PCT/US2015/020074.

(Continued)

*Primary Examiner* — Igor Kershteyn
(74) *Attorney, Agent, or Firm* — Honigman LLP

(57) ABSTRACT

An axial cooling fan for a vehicle includes an electrically powered motor operable to rotate fan blades to move air to cool a component or accessory of the vehicle. A stator is at the motor and has a plurality of struts that fixedly support the motor at the vehicle. The struts of the stator include leading edge surfaces that generally face air that is flowing towards the struts and past the struts and stator, such as when the motor is powered to rotate the fan blades. The leading edge surfaces of the struts comprise an aerodynamic design or pattern or structure established thereat, such as a toothed pattern or structure at the leading edge surfaces of the struts.

14 Claims, 11 Drawing Sheets

(52) U.S. Cl.
CPC .. *F05D 2240/121* (2013.01); *F05D 2240/122* (2013.01); *F05D 2250/18* (2013.01); *F05D 2250/183* (2013.01); *F05D 2250/75* (2013.01); *F05D 2300/43* (2013.01)

(58) Field of Classification Search
CPC ..... F05D 2250/18; F05D 2250/183; F05D 2250/75; F05D 2300/43
See application file for complete search history.

(56) References Cited

U.S. PATENT DOCUMENTS 4,720,239 A * 1/1988 Owczarek ..... F01D 5/141 415/119
4,761,115 A * 8/1988 Hopfensperger ..... F04D 29/663 415/119
5,466,120 A * 11/1995 Takeuchi ..... F04D 29/703 415/119
6,139,265 A * 10/2000 Alizadeh ..... F04D 29/544 415/208.1
6,398,492 B1 * 6/2002 Cho ..... F04D 29/544 415/191
6,866,474 B2 * 3/2005 Uselton ..... F04D 29/703 415/121.2
6,874,990 B2 4/2005 Nadeau
7,484,937 B2 2/2009 Johann
7,618,236 B2 * 11/2009 Hsu ..... F04D 29/542 415/121.2
7,661,927 B2 * 2/2010 Hsu ..... H05K 7/20172 415/121.2
7,811,055 B2 10/2010 Stommel et al.
2005/0271513 A1 12/2005 Johann
2007/0177971 A1 * 8/2007 Teraoka ..... F04D 29/283 415/53.1
2009/0028719 A1 * 1/2009 Teraoka ..... F04D 17/04 416/223 R
2009/0081036 A1 3/2009 Takeshita et al.
2015/0050133 A1 * 2/2015 Jiang ..... F04D 29/388 415/183

OTHER PUBLICATIONS

Chinese Search Report from corresponding Chinese Patent Application No. 201580013131.6 dated Feb. 5, 2018.

* cited by examiner $P_{AIR} = Q \cdot \Delta P$ $\eta_{CFM} = \eta_{MOTOR} * \eta_{AIR}$

80% USUALLY 45%..55%
WITH MEASURE 50%..60%

$$\eta_{AIR} = \frac{\text{AIR POWER OUTPUT}}{\text{MECHANICAL POWER OUTPUT}}$$

VEHICLE COOLING FAN WITH AERODYNAMIC STATOR STRUTS

CROSS REFERENCE TO RELATED APPLICATIONS

The present application is a 371 national phase filing of PCT Application No. PCT/US2015/020074, filed Mar. 12, 2015, which claims the filing benefits of U.S. provisional application Ser. No. 61/952,334, filed Mar. 13, 2014, which is hereby incorporated herein by reference in its entirety.

FIELD OF THE INVENTION

The present invention relates electrical motors for cooling fans of vehicles and, more particularly, to stators struts for electric motors for axial cooling fans of vehicles.

BACKGROUND OF THE INVENTION

It is known in cooling fan blower motors to have grooves and bumps on the fan blade's leading edges and outlet edges.

SUMMARY OF THE INVENTION

The present invention provides an axial cooling fan for a vehicle cooling application, with the fan having a motor mounting structure with surfaces or struts having aerodynamically designed leading edges to enhance air flow through the fan.

According to an aspect of the present invention, a cooling fan for a vehicle comprises an electrically powered motor operable to rotate fan blades to move air to cool a vehicle component or accessory and a stator apparatus having a plurality of struts that fixedly support the electric motor fan drive at the vehicle. The struts of the stator comprise leading edge surfaces that generally face air that is flowing towards the struts and past the struts when the motor is powered to rotate the fan blades. The leading surfaces of the struts comprise an aerodynamic design or pattern or structure established thereat.

Optionally, the aerodynamic design or pattern or structure established at the leading surfaces of said struts may comprise a jagged or toothed leading edge of the struts. Optionally, the struts comprise grooves or bumps along one or both sides of the struts along which the air flows as it passes the struts. The grooves or bumps may comprise at least one of (i) a pattern across the longitudinal and lateral extension of the strut, (ii) a zigzag shape, (iii) an s-shape, (iv) a c-shape and (v) a y-shape.

These and other objects, advantages, purposes and features of the present invention will become apparent upon review of the following specification in conjunction with the drawings.

LEGEND

1 Stator struts
2 Fan blades
3 Electric fan motor
4 Fan hub
5 Shroud
6 Cooling pack (HEX)
7 Adjacent element's strut

DESCRIPTION OF THE PREFERRED EMBODIMENTS

Figure 1:
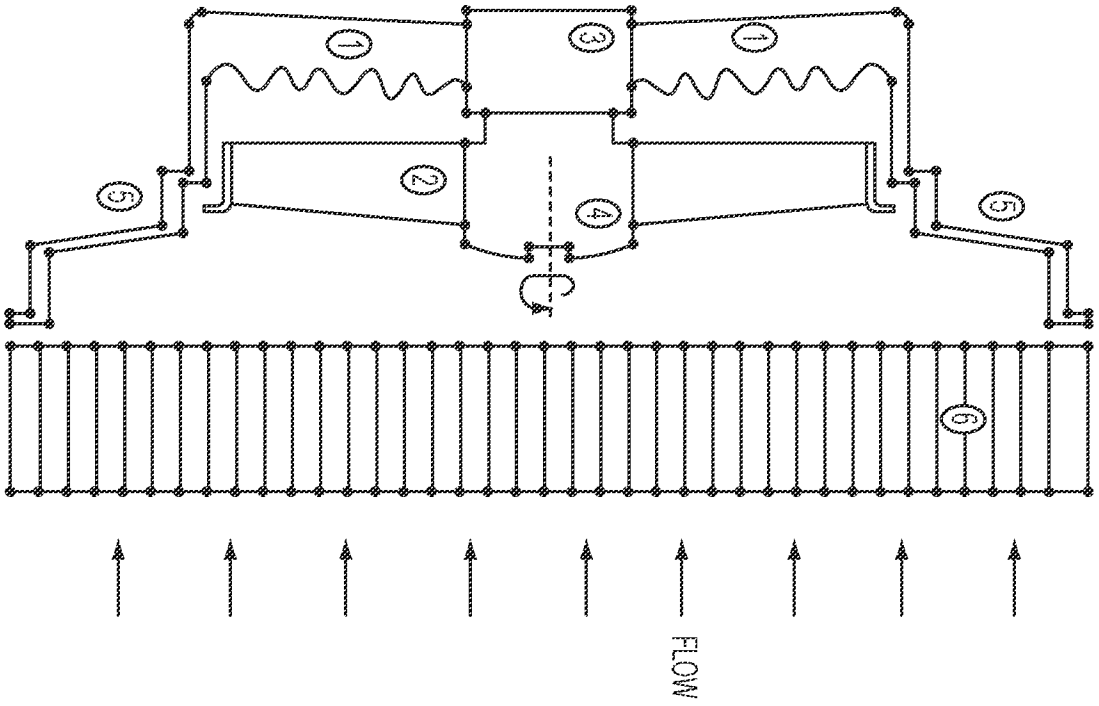
FIG. 1 is a sectional view of an axial fan module and vehicle cooling pack having teethed stator struts on the leading edge in accordance with the present invention.
Figure 2:
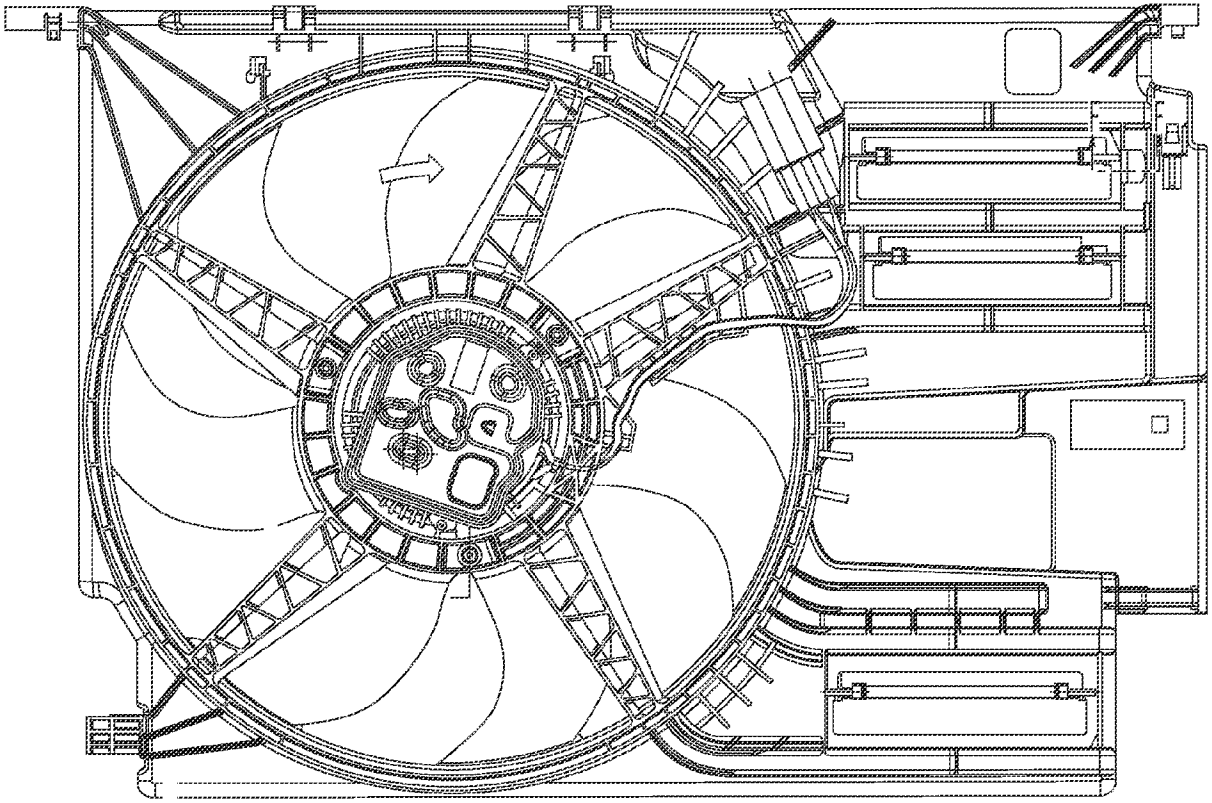
FIG. 2 shows views of a fan module of the present invention.

Vehicles with internal combustion engines (ICE) possess a heat exchanger (HEX) (6) (radiator or cooling packs) (such as shown in FIG. 1), typically at the front of the vehicle for cooling the engine coolant fluid. This heat exchanger requires fresh air from the ambient environment. E-cars possess heat exchangers for battery and inverter cooling. Both combustion and E-cars possess refrigerant condensing heat exchangers (condensers) for air-conditioning (A/C). Typically, most modern vehicles include both of these heat exchangers. In addition, in order to increase the power and efficiency of an ICE-powered vehicle, supplementary cooling packs are added, such as a charge-air cooler (CAC), also known as the intercooler for turbo-charger, transmission oil cooler (TOC), power-steering oil cooler (PSOC) and/or the like.

All of these heat exchangers are assembled to obtain the required ambient air flow to cool them. When the vehicle's own speed is too low to generate the air flow required to dispose the heat of the cooling water, there is a cooling fan (or two cooling fans) installed for moving additional air through the HEX. Due to aerodynamic preferences and vehicle safety regulations, the cooling fan (see reference number 2 in FIG. 1) is installed behind the HEX or cooling pack 6 in most of vehicles. A typical fan module assembly is contained within a shroud 5 as a fully assembled frame supplied independently from the HEX. As known, the cooling fan 2 is propelled by a BLDC (brushless direct current) motor 3. The rotating hub 4 holds the fan blades. The motor's non-moving part is held in the center of the shroud by the stators 1 (also called stator struts).

A low electrical power consumption at high air power output is desirable for keeping the blower motors and electrical power generators (of the vehicle) as small, light and cheap as possible while achieving acceptable cooling results. The air power output, $P_{air}$, is expressed as the product of volumetric flow (Q) (or $\dot{v}$) and pressure rise ($\Delta P$) across the fan by the equation $P_{air}=Q\times\Delta P$. The electromechanical overall cooling fan module efficiency is expressed as $\eta_{MOD}$, wherein:

$$\eta_{MOD}=P_{air}/P_{electrical}, \quad (1)$$

where $P_{electrical}$ is the electrical power consumed by the motor drive.

The fan's aerodynamic efficiency is expressed as $\eta_{air}$, wherein:

$$\eta_{air}=P_{air}/P_{mechanical} \quad (2)$$

Figure 3:
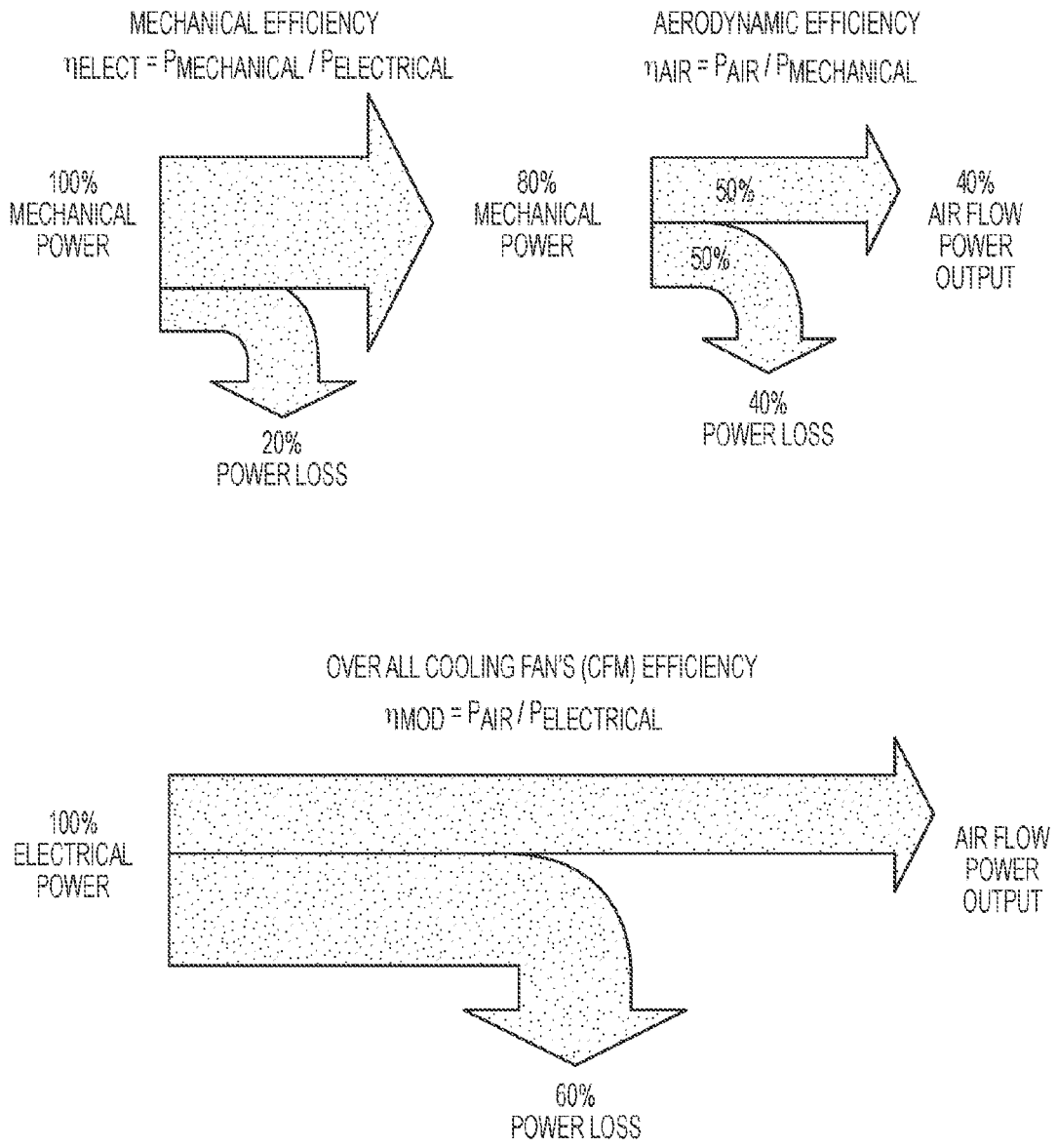
FIG. 3 shows efficiency diagrams of the efficiencies of the fan of the present invention.

The cooling fan's motor drive efficiency is expressed $\eta_{electrical}$, wherein:

$$\eta_{electrical}=P_{mechanical}/P_{electrical}, \quad (3)$$

where $P_{mechanical}$ is also known as shaft power, defined by the product of the torque (T) and angular speed ($\omega$). $P_{mechanical}=T\times\omega$ (See FIG. 3).

Figure 4:
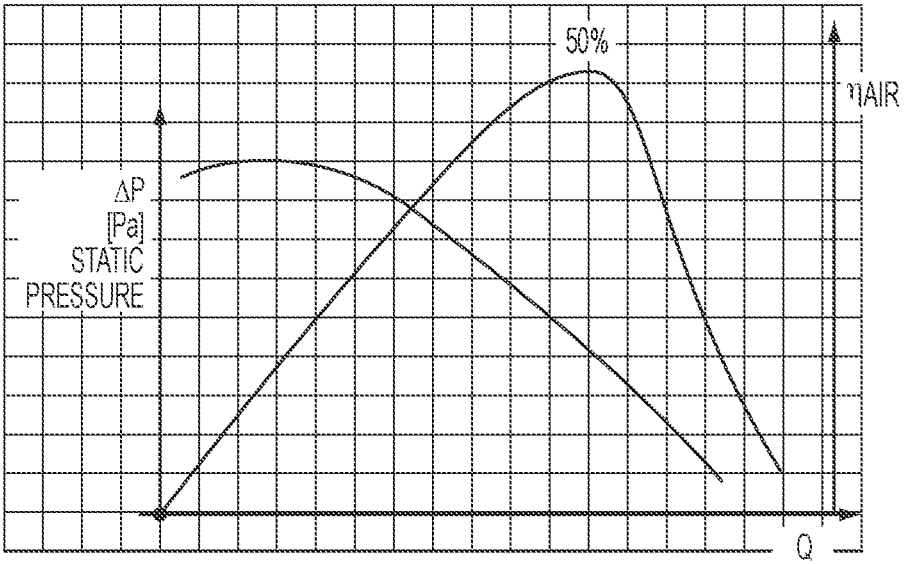
FIG. 4 shows performance calculations of the fan of the present invention.
Figure 5:
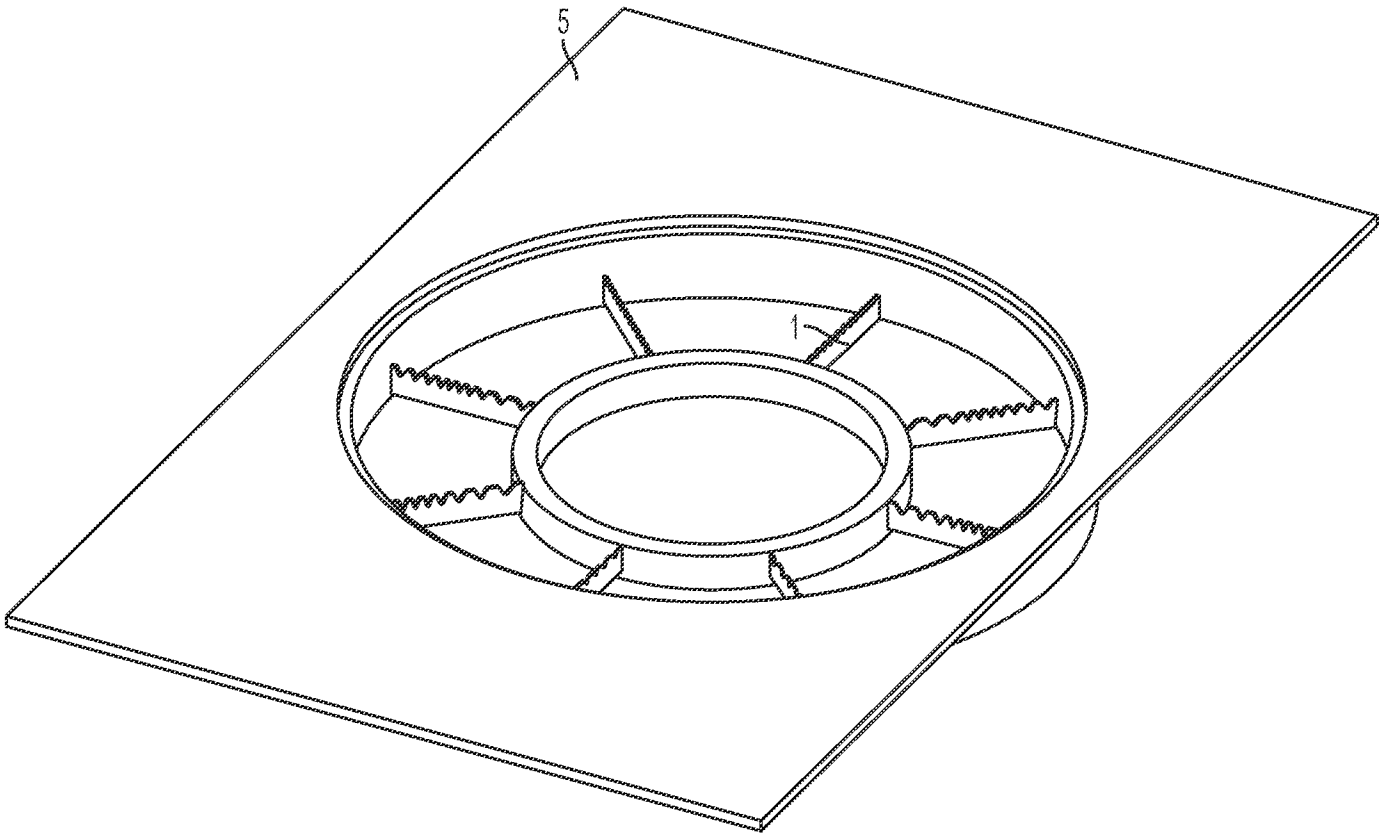
FIG. 5-7 are perspective views in different degrees of enlargement of a fan module shroud with teethed motor stator struts on the leading edge in accordance with the present invention, without showing the motor, fan blades, fan hub and cooling pack.
Figure 6:
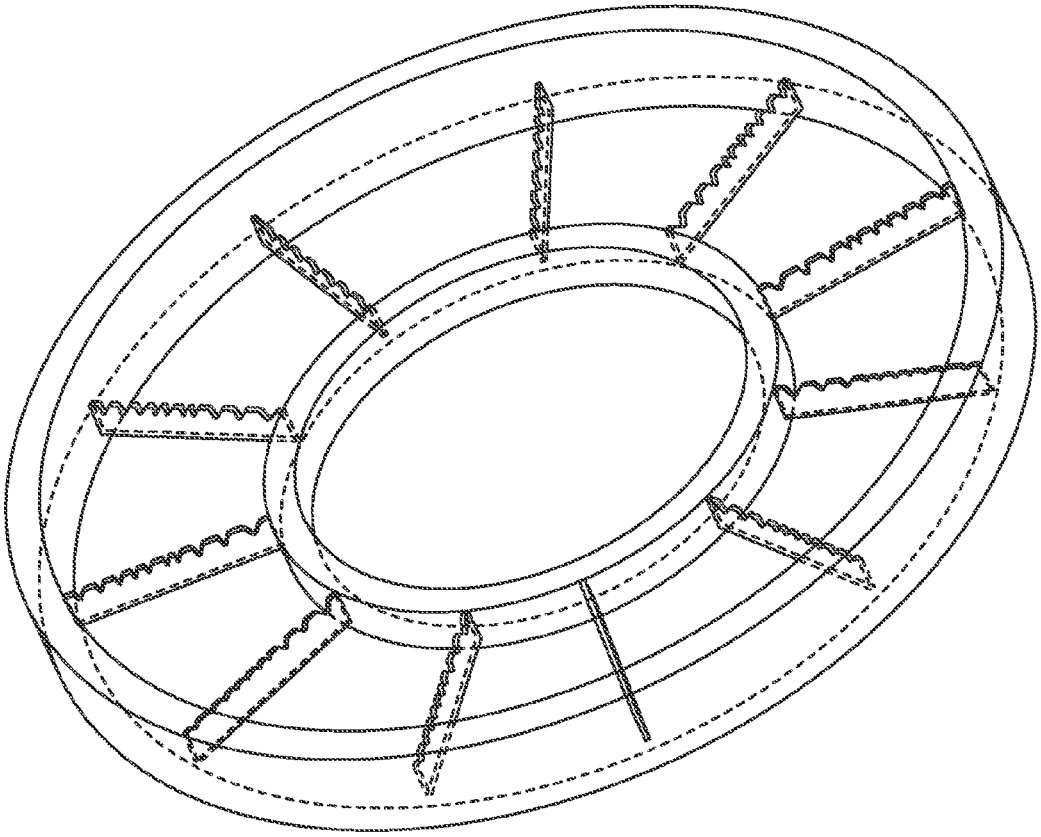
Figure 7:
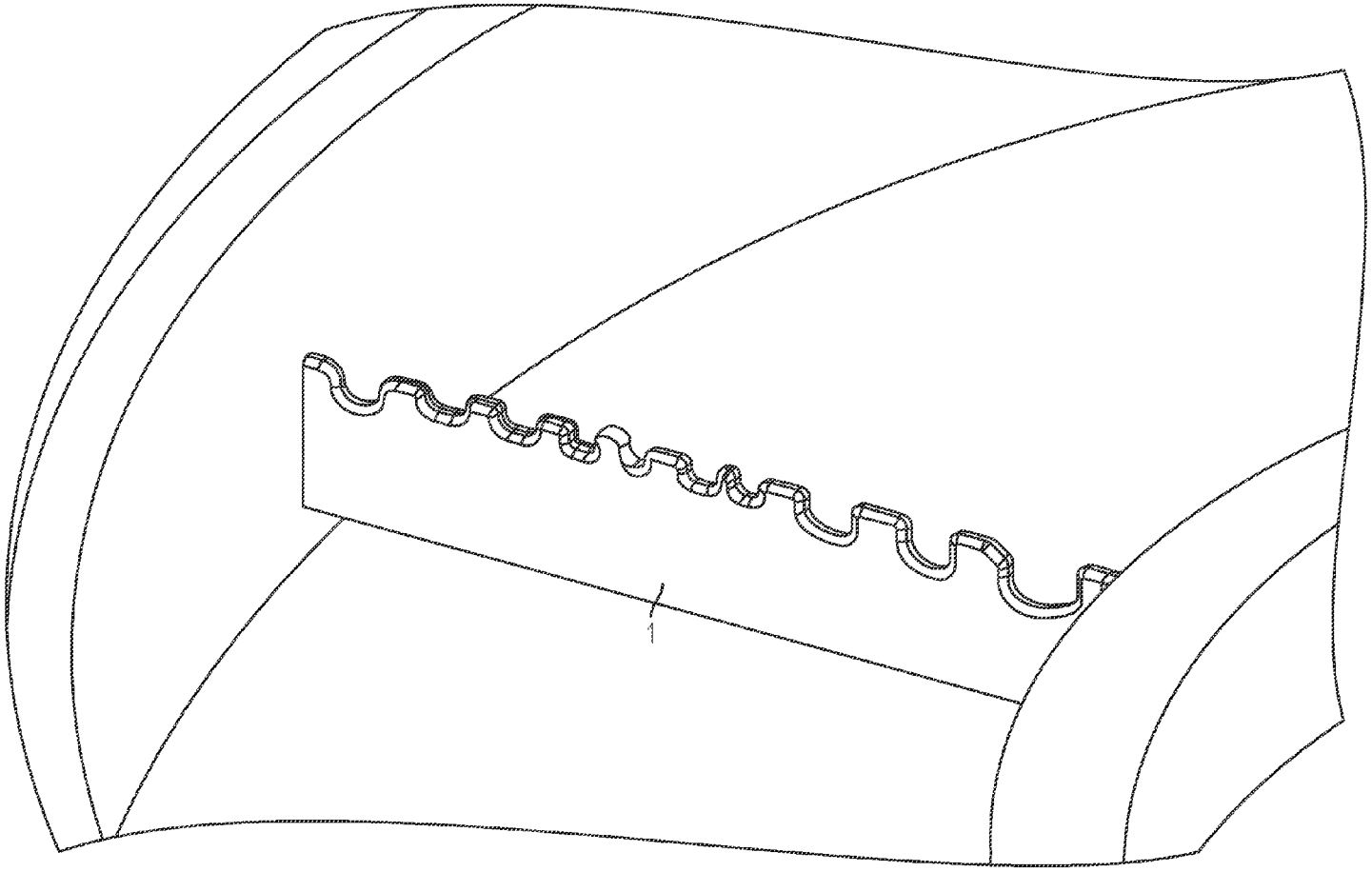
Figure 8:
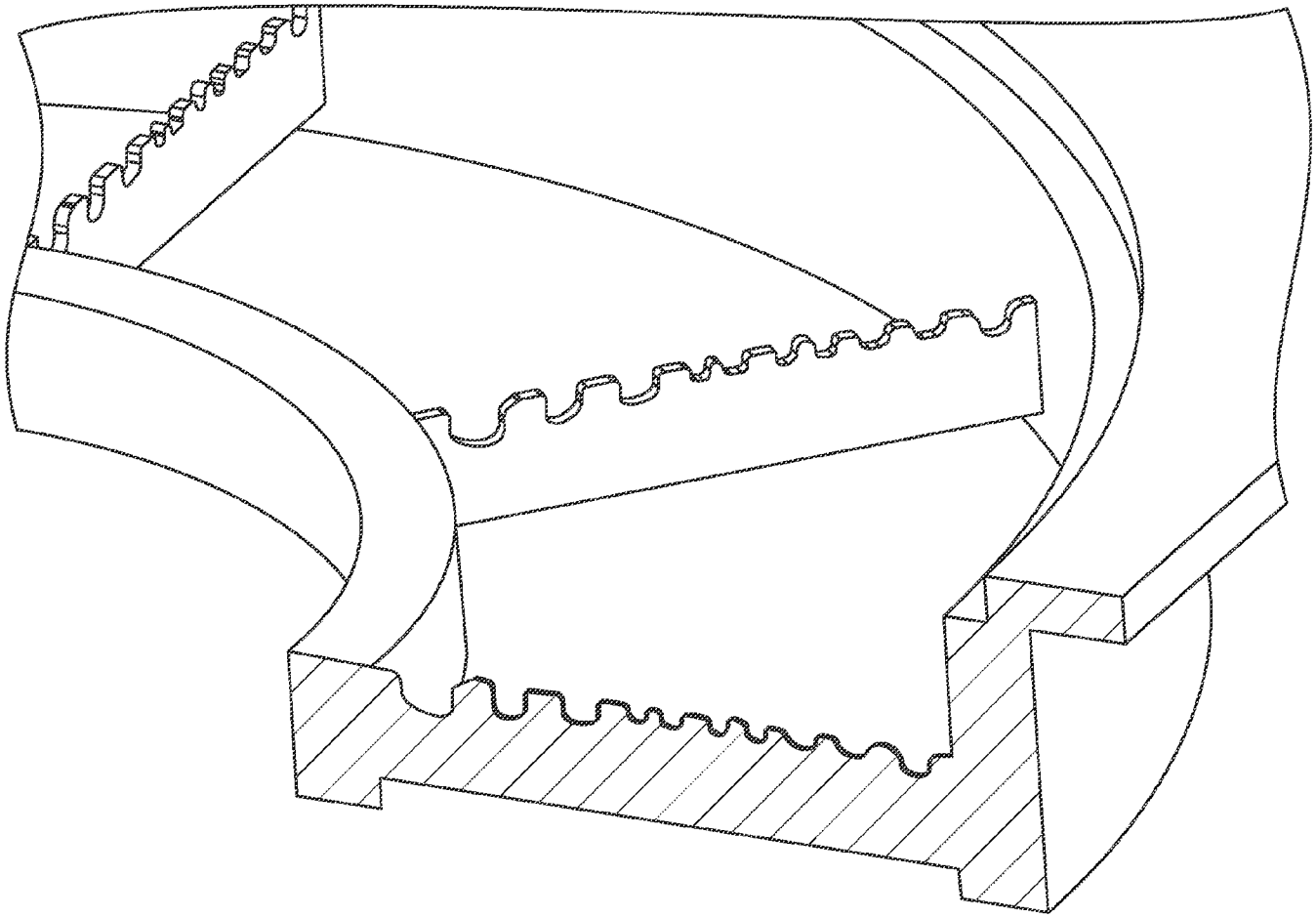
FIGS. 8 and 9 are perspective and partial sectional views of a fan module shroud with teethed motor stator struts on the leading edge in accordance with the present invention.
Figure 9:
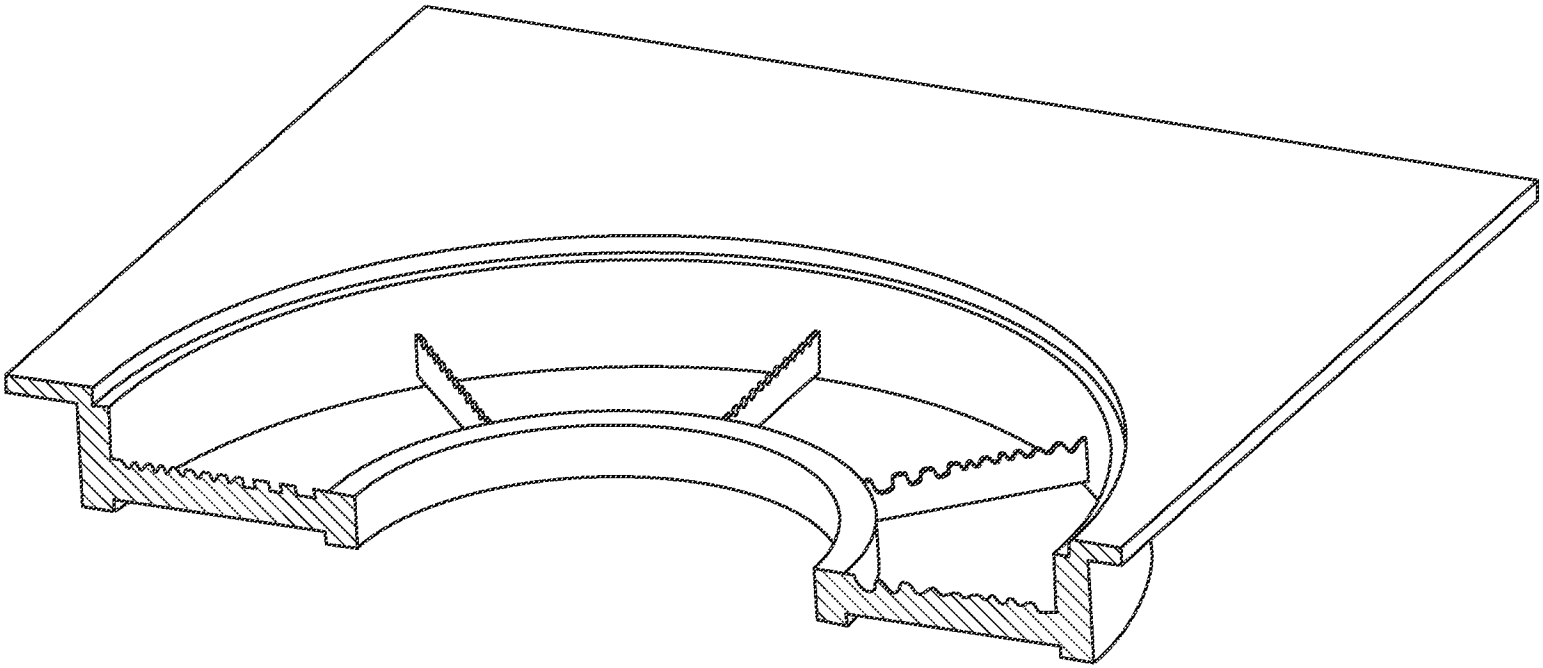

Because the operating efficiency of the air power is greatly flow-rate dependent, the air power efficiency is for most operating ranges much less efficient than the maximum efficiency of 50 percent (see FIG. 4). The typical electrical efficiency is at about 80 percent. It becomes clear that it is desirable to improve an overall efficiency of the cooling fan system having less than $\eta_{MOD}=\eta_{electrical}\times\eta_{air}$ $(0.8_{max}*0.5_{max})=0.4_{max}$. A single percentage improvement in the air flow efficiency has almost double the effect on the overall module efficiency than an equal improvement in the electrical efficiency. Meanwhile, it is harder and less effective and expensive to improve the electrical efficiency.

To improve the aerodynamic efficiency of airplane wings, airplane propellers, aero plane turbine blades, marine propellers, wind turbine rotors, helicopter rotors, ventilator fan blades and vehicle cooling fan blades (radial and axial), it is known to improve the aerodynamic properties and with it the air efficiency by designing them in specific shapes having grooves and/or bumps and/or knobs and/or serrated leading and/or trailing edges. For wind turbines it is known to design the shape of the steady circumjacent tube.

To improve the aerodynamic efficiency of (axial) vehicle cooling fan systems, especially engine radiator cooling fans, the present invention applies an aerodynamic design to the stator struts (or beams), especially at the areas exposed to the oncoming air flow. For example, the stator struts may possess a jagged or toothed leading (exposed to the oncoming air flow) edge such as shown in FIGS. 1 and 5-11.

Optionally, the stator struts may comprise a jagged or toothed trailing edge as an alternative or as an addition. Optionally, the jags or teeth have a symmetric distribution across the longitudinal extension of a strut exposed to the air flow. Optionally, the jags or teeth have a mathematically describable distribution across the longitudinal extension of a strut exposed to the air flow. Optionally, the jags or teeth have a random, chaotic or empirically determined distribution (such as by bionics (inspiring or copying from biological designs such as from a Condor's wing) by simulation or trial and error) across the longitudinal extension of a strut exposed to the air flow. Optionally, the widths of the jags or teeth may be equal or substantially equal across the longitudinal extension of a strut exposed to the air flow. Optionally, the widths of the jags or teeth may differ in a mathematically describable manner across the longitudinal extension of a strut exposed to the airflow. Optionally, the widths of the jags or teeth may differ in a random, chaotic or empirically determined manner across the longitudinal extension of a strut exposed to the air flow. Optionally, the jags or teeth distance may be equal or substantially equal across the longitudinal extension of a strut exposed to the air flow. Optionally, the jags or teeth distance may differ in a mathematically describable manner across the longitudinal extension of a strut exposed to the air flow. Optionally, the jags or teeth distance may differ in a random, chaotic or empirically determined manner across the longitudinal extension of a strut exposed to the air flow.

Optionally, the struts exposed to the air flow may comprise surfaces that face substantially orthogonal to the air flow. In accordance with the present invention, these surfaces may comprise grooves and/or bumps and/or knobs for lowering the friction resistance of the air passing over these surfaces and by that improving the efficiency of the cooling fan system. Optionally, the surface's grooves, bumps or knobs may have a symmetric distribution across the longitudinal extension of the strut. Optionally, the surface's grooves, bumps or knobs may have a symmetric distribution across the lateral extension of the strut (substantially parallel to the air flow). Optionally, the surface's grooves, bumps or knobs may have a mathematically describable distribution across the longitudinal extension of the strut. Optionally, the surface's grooves, bumps or knobs may have a mathematically describable distribution across the lateral extension of the strut (substantially parallel to the air flow). Optionally, the surface's grooves, bumps or knobs may have a random, chaotic or empirically determined distribution across the longitudinal extension of the strut. Optionally, the surface's grooves, bumps or knobs may have a random, chaotic or empirically determined distribution across the lateral extension of the strut (substantially parallel to the air flow).

Optionally, the grooves or bumps depths or knobs heights may be equal or substantially equal across the longitudinal extension of a strut exposed to the air flow. Optionally, the grooves or bumps depths or knobs heights may differ in a mathematically describable manner across the longitudinal extension of a strut exposed to the air flow. Optionally, the grooves or bumps depths or knobs heights may differ in a random, chaotic or empirically determined manner across the longitudinal extension of a strut exposed to the air flow.

Optionally, the grooves or bumps depths or knobs heights may be equal or substantially equal across the lateral (substantially parallel to the air flow) extension of a strut exposed to the air flow. Optionally, the grooves or bumps depths or knobs heights may differ in a mathematically describable manner across the lateral (substantially parallel to the air flow) extension of a strut exposed to the air flow. Optionally, the grooves or bumps depths or knobs heights may differ in a random, chaotic or empirically determined manner across the lateral (substantially parallel to the air flow) extension of a strut exposed to the air flow.

Figure 10:
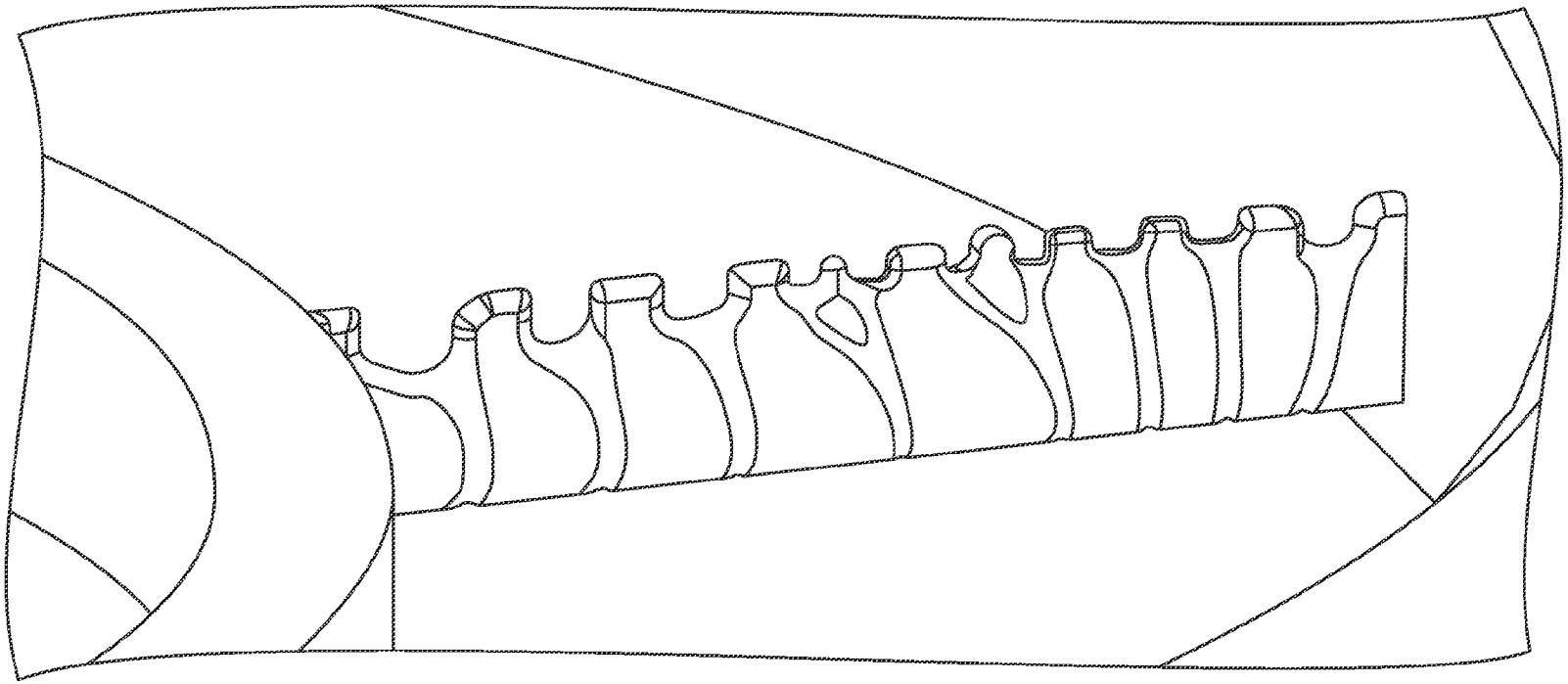
FIG. 10 is a perspective view of a fan module motor stator strut with teeth on the leading edge and S-shaped, C-shaped and Y-shaped grooves on the surface which is substantially orthogonal to the air flow direction starting in between the teeth which may be generated empirically.

Optionally, the grooves or bumps depths or knobs distribution may follow a pattern across the longitudinal and lateral extension of the strut. Optionally, the grooves or bumps depths or knobs heights may have a pattern across the longitudinal and lateral extension of the strut. Optionally, the grooves on the surface which is facing substantially orthogonal to the air flow may have a zigzag shape, s-shape, c-shape (describing a curve), y-shape (such as shown in FIG. 10) or may cross each other. These shapes and/or patterns may be empirically found/determined (such as by bionics (inspiring or copying from biological designs such as like from a Condors wing) or by simulation or trial and error).

Optionally, the teeth for improving aerodynamic properties may have round heads, triangle shaped heads or rectangle shaped heads or in combination. Any and all of the options described above may be applied alone or in combination.

Figure 11:
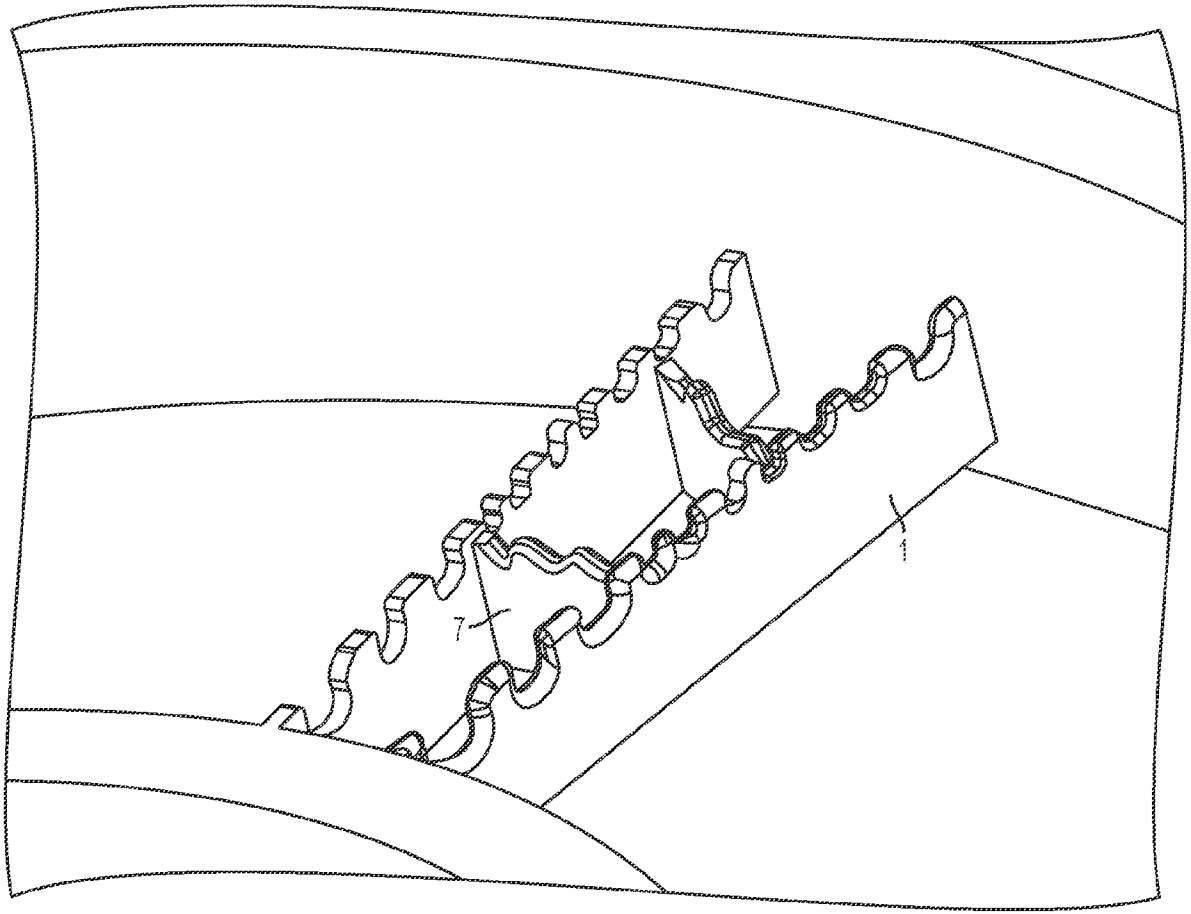
FIG. 11 is a perspective view of adjacent fan module motor stator struts with teeth on the leading edge and additional connective elements or webs in between the adjacent struts also having teeth in accordance with the present invention.

Optionally, the struts may have connective elements or webs in between. Optionally, the connective elements or webs may have teeth, bumps, grooves and/or knobs for improving the aerodynamic properties, such as described in the options above for the struts, and such as shown in FIG. 11.

As another aspect of the invention, the motor struts' surfaces exposed to the air flow may be nanostructured for reducing the air friction by miniature swirls or turbulences. The structures may be applied by the insertion molding tool or by sticking or applying a structured foil onto the strut or by stamping it on the strut after the molding process.

A sophisticated application process was shown by Fraunhofer IFAM in http://www.ifam.fraunhofer.de/content/dam/ifam/de/documents/IFAM-Bremen/2804/fachinfo/infoblaetter/en/oe415/Produktblatt-2804-EN-Lacktechnik-Riblet.pdf.

The structure may be generated empirically or inspired bionically. For example, the structures may be similar in size and shape, such as the surface of butterfly wings, rice leafs, fish scales or a shark's skin riblets. The single structures of shark skins are in the size area of 100 μm. Known technically approaches to come close to a shark skin surface are made by Shartlet™.

Changes and modifications in the specifically described embodiments can be carried out without departing from the principles of the invention, which is intended to be limited only by the scope of the appended claims, as interpreted according to the principles of patent law including the doctrine of equivalents.

The invention claimed is:

1. An axial cooling fan for a vehicle, said axial cooling fan comprising:

an electrically powered motor operable to rotate fan blades to move air to cool a component of the vehicle;

a stator at said motor having a plurality of struts that fixedly support said motor at the vehicle;

wherein said struts of said stator comprise leading edge surfaces that generally face air that is flowing towards said struts and past said stator;

wherein said leading edge surfaces of said struts comprise an aerodynamic design or pattern or structure established thereat;

wherein said aerodynamic design or pattern or structure established at said leading edge surfaces of said struts comprises a toothed leading edge of said struts;

wherein said struts comprise a trailing edge and sides extending between said leading edge surfaces and said trailing edges, and wherein said struts comprise grooves along at least one of said sides of said struts along which the air flows as it passes said struts; and wherein said grooves comprise at least one of (i) a pattern across the longitudinal and lateral extension of said strut, (ii) a zigzag shape, (iii) an s-shape, (iv) a c-shape and (v) a y-shape.

2. The axial cooling fan of claim 1, wherein said grooves extend from a recess between adjacent teeth of said leading edge and along said at least one of said sides towards said trailing edge.

3. The axial cooling fan of claim 2, wherein at least one of said grooves comprises a y-shape and extends from recesses at opposite sides of a tooth of said leading edge towards said trailing edge.

4. The axial cooling fan of claim 1, wherein said struts comprise bumps along at least one of said sides of said struts along which the air flows as it passes said struts.

5. The axial cooling fan of claim 1, wherein individual teeth of said toothed leading edge are different from other individual teeth of said toothed leading edge.

6. The axial cooling fan of claim 5, wherein individual teeth of said toothed leading edge have at least one of (i) different shapes and (ii) different sizes.

7. The axial cooling fan of claim 1, wherein adjacent struts are connected via at least one connective element between said adjacent struts and wherein said at least one connective element comprises a leading surface that has an aerodynamic design or pattern or structure established thereat.

8. The axial cooling fan of claim 1, wherein said struts comprise molded polymeric struts.

9. The axial cooling fan of claim 8, wherein said aerodynamic design or pattern or structure established at said leading edge surfaces of said struts are integrally molded with said struts.

10. The axial cooling fan of claim 8, wherein said aerodynamic design or pattern or structure established at said leading edge surfaces of said struts are attached to said struts.

11. An axial cooling fan for a vehicle, said axial cooling fan comprising:

an electrically powered motor operable to rotate fan blades to move air to cool a component of the vehicle;

a stator at said motor having a plurality of struts that fixedly support said motor at the vehicle;

wherein said struts comprise molded polymeric struts;

wherein said struts of said stator comprise leading edge surfaces that generally face air that is flowing towards said struts and past said stator;

wherein said leading edge surfaces of said struts comprise an aerodynamic design or pattern or structure established thereat;

wherein said aerodynamic design or pattern or structure established at said leading edge surfaces of said struts comprises a toothed leading edge of said struts;

wherein said aerodynamic design or pattern or structure established at said leading edge surfaces of said struts are integrally molded with said struts;

wherein said struts comprise a trailing edge and sides extending between said leading edge surfaces and said trailing edges, and wherein said struts comprise grooves along at least one of said sides of said struts along which the air flows as it passes said struts; and wherein said grooves comprise at least one of (i) a pattern across the longitudinal and lateral extension of said strut, (ii) a zigzag shape, (iii) an s-shape, (iv) a c-shape and (v) a y-shape, and wherein said grooves extend from a recess between adjacent teeth of said leading edge and along said at least one of said sides towards said trailing edge.

12. The axial cooling fan of claim 11, wherein said struts comprise bumps along at least one of said sides of said struts along which the air flows as it passes said struts.

13. The axial cooling fan of claim 11, wherein individual teeth of said toothed leading edge are different from other individual teeth of said toothed leading edge, and wherein individual teeth of said toothed leading edge have at least one of (i) different shapes and (ii) different sizes.

14. The axial cooling fan of claim 11, wherein adjacent struts are connected via at least one connective element between said adjacent struts and wherein said at least one connective element comprises a leading surface that has an aerodynamic design or pattern or structure established thereat.

* * * * *